United States Patent [19]

Cobble

[11] 4,235,175

[45] Nov. 25, 1980

[54] LOOP FORMING AND CUTTING APPARATUS FOR TUFTING MACHINE

[75] Inventor: James T. Cobble, Dalton, Ga.

[73] Assignee: B & J Machinery Company, Inc., Dalton, Ga.

[21] Appl. No.: 954,936

[22] Filed: Oct. 26, 1978

[51] Int. Cl.[2] ..... D05C 15/00

[52] U.S. Cl. ..... 112/79 R; 112/277

[58] Field of Search ..... 112/79 R, 79 A, 129, 112/277

[56] References Cited

U.S. PATENT DOCUMENTS

| | | | |
|---|---|---|---|
| 1,800,522 | 4/1931 | Gladish | 112/79 R |
| 1,855,916 | 4/1932 | Keeney | 112/79 R |
| 1,892,161 | 12/1932 | Murphey | 112/79 R |
| 1,913,560 | 6/1933 | Murphey . | |
| 1,984,772 | 12/1934 | Stewart | 112/79 R |
| 2,070,287 | 2/1937 | Loos | 112/79 R |
| 2,095,916 | 10/1937 | Cagle | 112/79 R |
| 2,194,876 | 3/1940 | Sparks | 112/79 R |
| 2,256,633 | 9/1941 | Turley | 112/79 R |
| 2,411,833 | 12/1946 | Kile | 112/79 R |
| 2,513,261 | 6/1950 | Behrens | 112/79 A |
| 2,589,340 | 3/1952 | Chamber | 112/79 R |
| 2,748,444 | 6/1956 | Rice | 112/79 R |
| 2,800,096 | 7/1957 | Signoret | 112/79 R |
| 2,997,009 | 8/1961 | Ballard | 112/79 R |
| 3,324,812 | 6/1967 | Smith | 112/79 A |

FOREIGN PATENT DOCUMENTS

| | | | |
|---|---|---|---|
| 767333 | 7/1934 | France | 112/79 R |

*Primary Examiner*—Ronald Feldbaum

*Attorney, Agent, or Firm*—Bell, Seltzer, Park & Gibson

[57] ABSTRACT

A loop forming and cutting apparatus for a tufting machine which comprises a looper having a forwardly directed bill, a slot disposed transversely through a substantial portion of the length of the bill, and a blade pivotally mounted to the looper, with the cutting edge portion thereof extending into the slot. Thus the lower edge of the bill and the cutting edge of the blade form a forwardly facing, scissors-like bight which acts to sever the yarn loops as they move rearwardly along the bill. Means are provided for terminating operation of the tufting machine when any one of the blades becomes dull.

13 Claims, 8 Drawing Figures

LOOP FORMING AND CUTTING APPARATUS FOR TUFTING MACHINE

The present invention relates to a yarn loop forming and cutting apparatus for use in a cut pile tufting machine.

Tufting machines of varied design have heretofore been employed which cyclically carry yarn through a backing fabric to form a plurality of loops, and which sever the loops to form a cut pile. Generally, such prior machines comprise a needle bar which mounts a plurality of needles and extends generally across the machine, means for reciprocating the needle bar between raised and lowered positions whereby the needles cyclically penetrate the backing fabric, means for guiding a yarn to each needle, and a looper and knife mounted on individual oscillating bars such that the loops are successively deposited on the looper and then severed by the knife.

The required structure for mounting and reciprocating conventional loopers and knives has been a source of several persistent difficulties. In particular, the loopers must be accurately aligned and moved with respect to the needles so as to properly enter the yarn loops, and the mounting and reciprocating structure for the loopers and knives is necessarily relatively complex and heavy. Thus substantial power is required for their rapid movement, and in addition, the relative movement of the loopers and knives generates a great deal of friction which further increases the power consumption and results in the rapid wearing of these components. Further, the knives tend to sever the loops of yarn slightly off center, resulting in one cut length of the loop being slightly longer than the other. This off center cutting is known as J-cutting in the art, and often results in visible lines on the face of the fabric. Still further, conventional knives are difficult to replace and align.

It is accordingly an object of the present invention to provide a loop forming and cutting apparatus for a tufting machine which effectively overcomes the above noted deficiencies of the prior machines.

It is a more particular object of the present invention to provide a loop forming and cutting apparatus for a tufting machine wherein there is substantially no relative movement between the looper and knife portions, whereby the mounting structure is greatly simplified and the power consumption of the machine is minimized.

It is a further object of the present invention to provide a loop forming and cutting apparatus for a tufting machine which avoids J-cutting of the loops, and wherein the knives may be readily changed and aligned.

It is still another object of the present invention to provide a loop forming and cutting apparatus for a tufting machine which has provision for automatically stopping operation of the machine when any one of the knives becomes dull.

These and other objects and advantages of the present invention are achieved in the embodiment illustrated herein by the provision of a looper which has an elongate forwardly directed bill and which defines a longitudinally extending substantially straight edge, a cutting knife or blade having an elongate, straight cutting edge, and means for movably mounting the blade to the looper such that the cutting edge of the blade cooperates with the edge of the bill to form a scissors-like bight therebetween, and with the bight facing forwardly. In addition, means are provided for resiliently biasing the blade toward the edge of the looper bill, whereby loops of yarn may be moved rearwardly along the bill and severed upon reaching the bight.

In the preferred embodiment, at least a substantial portion of the bill of the looper is composed of a pair of flat components which are parallel to each other and spaced apart to define a slot therebetween. The blade is mounted so that the cutting edge thereof extends into the slot in the looper, with the forward portion of the blade cutting edge abutting the forward end of the slot to limit movement of the blade into the slot, and such that the bight remains open to admit the yarn loops therein. The blade will thus gradually move away from the bill as the forward portion of the cutting edge becomes dull, and so that the loops advance to the sharper rear portion of the cutting edge. The tufting machine further includes photoelectric sensing means disposed adjacent the side of the loopers opposite the needles, for detecting movement of any cutting blade away from the bill beyond a predetermined limit, to thereby monitor the sharpness of the cutting edge of each blade. A signal from the sensing means may be employed for automatically terminating operation of the machine, so that the dull blade may be changed before any damage to the tufted fabric occurs.

Some of the objects having been stated, other objects will appear as the description proceeds, when taken in connection with the accompanying drawings in which.

Figure 1:
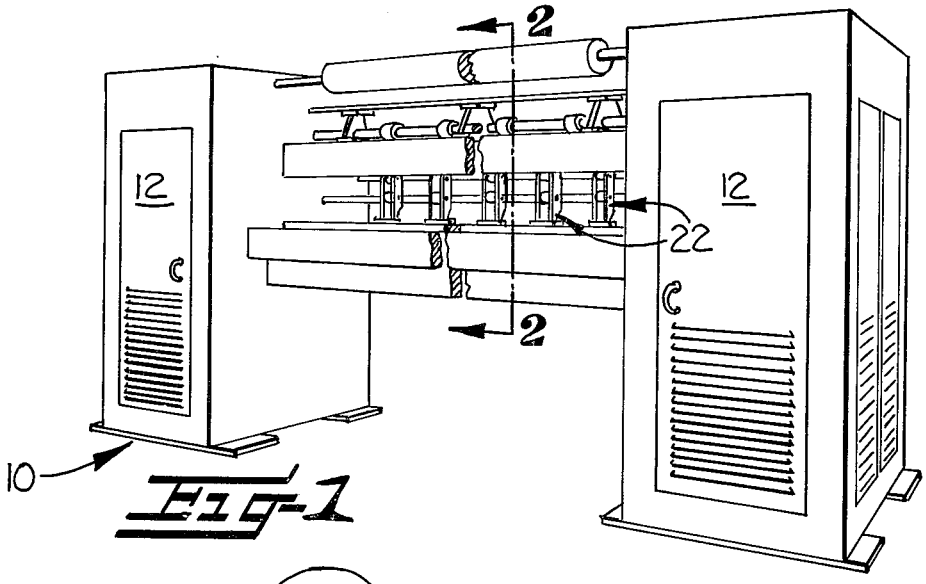
FIG. 1 is a perspective view of a tufting machine which embodies the loop forming and cutting apparatus of the present invention.

Referring more specifically to the drawings, FIG. 1 illustrates generally at 10 a tufting machine which embodies the yarn loop forming and cutting apparatus of the present invention. The machine 10 is described in detail in applicant's copending application Ser. No. 954,937, filed concurrently herewith, and entitled "Tufting Machine." The disclosure of this copending application is expressly incorporated herein by reference.

Figure 3:
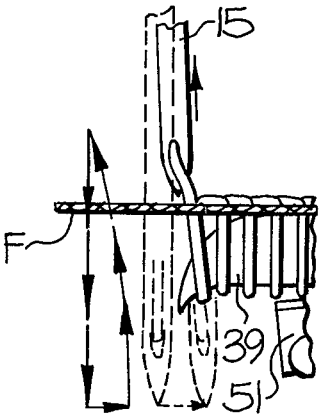
FIG. 3 is a fragmentary elevation view of the forward portion of the loop forming and cutting apparatus, and illustrating the manner in which the needles of the machine act to deposit the yarn loops on the looper bill.

As more particularly described in the referenced copending application, the machine 10 includes a frame including a pair of spaced apart, fixed end supports 12, means including feed rolls (not shown) for feeding an elongate backing fabric F longitudinally between the end supports, and elongate needle bar 14 mounting a row of spaced tufting needles 15 which are adapted to carry yarns Y through the backing fabric F, and means for mounting the needle bar between the end supports for reciprocation between raised and lowered positions and such that the needles cyclically penetrate the backing fabric F and are moved laterally in the direction of fabric movement while penetrating the fabric, note FIG. 3.

The mounting and reciprocating means of the machine 10 comprises a drive shaft 16 rotatably mounted between the end supports and parallel to the needle bar, a rocker shaft 18 rotatably mounted between the end supports and disposed parallel to the drive shaft, and a pivot shaft 20 mounted between the end supports and disposed parallel to the drive shaft and rocker shaft. A plurality of like mounting assemblies 22 interconnect these three shafts to the needle bar 14. The mounting assemblies 22 are spaced apart along the width of the machine between the end supports, and each comprises a push rod arm 24 having one end fixed to the needle bar 14 and extending therefrom in a direction generally perpendicular to the backing fabric F. The pivot shaft 20 is operatively connected to the medial portion of the push rod arm 24 by a pivot arm 25 which is rotatably mounted on the shaft 20 and is pivotally connected to the arm 24. The rocker shaft 18 is operatively connected to the upper free end of the push rod arm 24 by a linkage which includes a first arm 26 fixed to the rocker shaft 18, and a second arm 28 having one end pivotally connected to the end of the push rod arm 24 and another end pivotally connected to the first linkage arm 26.

Figure 2:
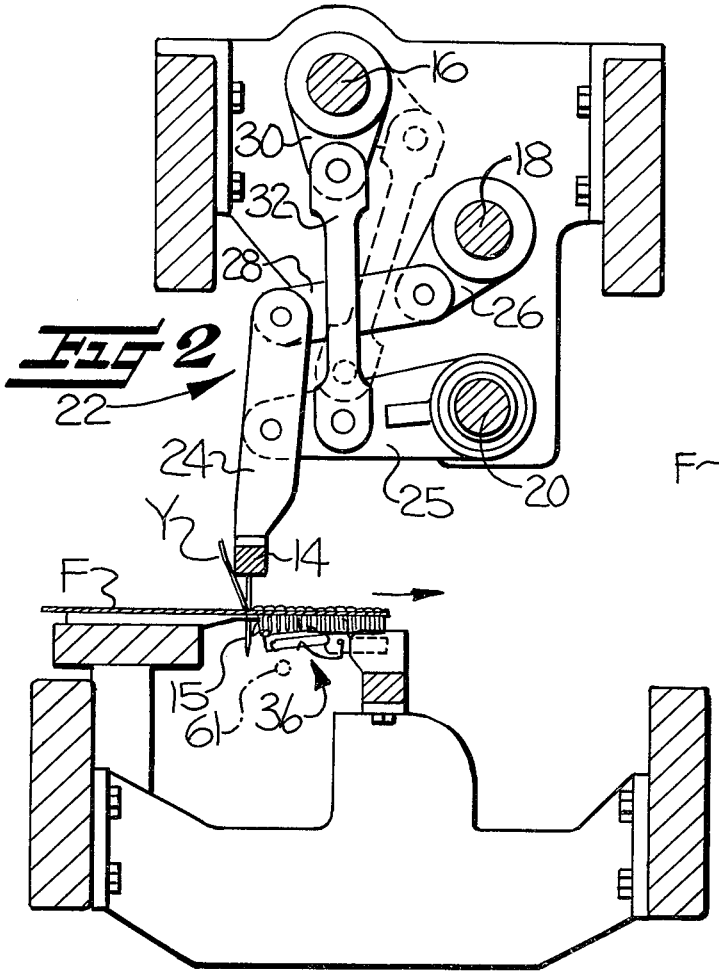
FIG. 2 is a sectioned side elevation view taken substantially along the line 2—2 of FIG. 1.

The drive shaft 16 is operatively connected to the needle bar 14 by an arrangement which includes a crank arm 30 fixed to the drive shaft, and a connecting arm 32 having its upper end pivotally connected to the crank arm, and its lower end pivotally connected to the pivot arm 25 at a medial point along its length. Means are also provided for oscillating the drive shaft 16, which causes the crank arm 30 and connecting arm 32 to move between the solid and dashed line positions as shown in FIG. 2, and which results in the needles 15 being cyclically raised and lowered to penetrate the backing fabric. Also, means are provided for cyclically oscillating the rocker shaft 18, causing the push rod arm 24 to rotate about the pivotal connection between the pivot arm 25 and push rod arm, in a counterclockwise direction as seen in FIG. 2, and while the needles 15 have penetrated the fabric F, thereby resulting in the needles moving in the direction of fabric movement. This lateral movement of the needles 15 serves to deposit the formed yarn loops upon the stationary looper in the manner illustrated in FIG. 3.

In accordance with the present invention, there is provided a loop forming and cutting apparatus 36 for each of the needles 15. Each apparatus 36 is fixed to the frame of the machine 10 on the side of the backing fabric F opposite the needle bar 14, with the several apparatus being aligned in a transverse row across the width of the machine.

Figure 5:
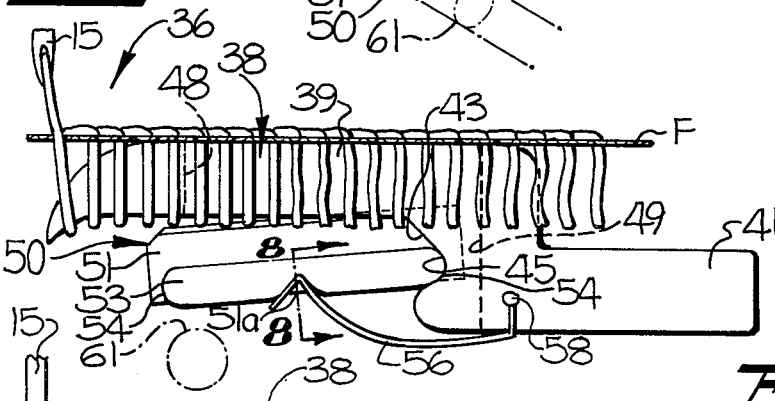
FIG. 5 is an elevation view of the loop forming and cutting apparatus, and illustrating the same in its normal operating position.
Figure 6:
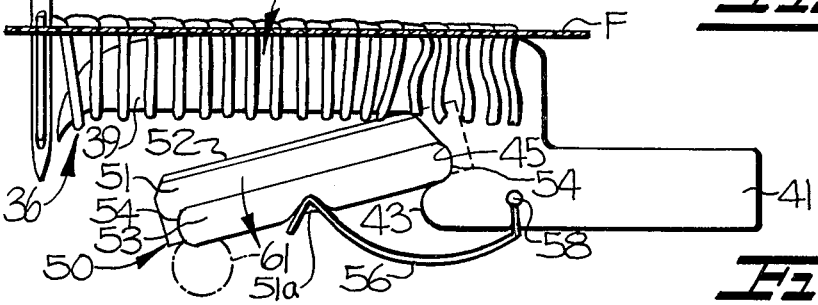
FIG. 6 is a view similar to FIG. 5 but illustrating the operating position when the cutting blade has become dull.
Figure 7:
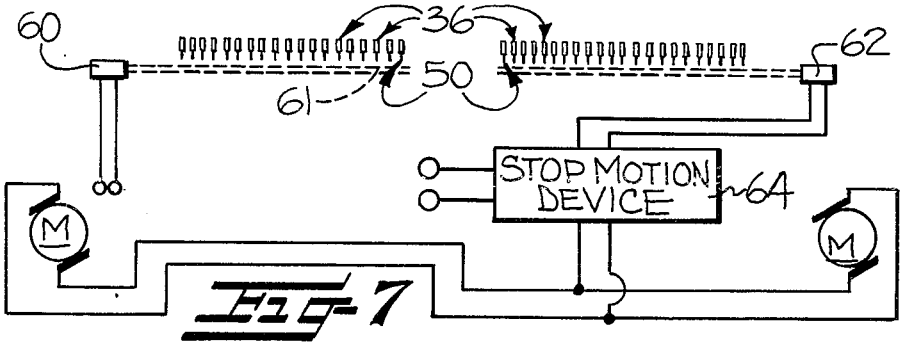
FIG. 7 is a schematic view of the means for terminating operation of the machine upon a blade becoming dull.

More particularly, each apparatus 36 includes a generally flat looper 38 which comprises a longitudinally extending bill 39 having a longitudinally extending, generally straight, lower edge 40, an oppositely extending mounting portion 41, and an intermediate portion 42 having a second edge 43 which communicates with the lower edge 40 of the bill. As best seen in FIGS. 5 and 6, the second edge 43 extends generally transversely from the lower edge 40 of the bill and includes an arcuately curved portion which defines a concave seat 45.

The looper 38 is preferably composed of a pair of flat components which are parallel to each other and spaced apart along a portion of their longitudinal length to define a slot 46 therebetween. As illustrated, the slot 46 extends transversely through the looper from a forward edge 48 adjacent the forward end of the bill to a rear edge 49 midway along the intermediate portion 42, and thus the slot communicates with a substantial portion of the lower edge 40 of the bill 39, as well as the transverse edge 43. The two components of the looper are fixedly interconnected by any suitable means, such as brazing along the contiguous edges.

Figure 8:
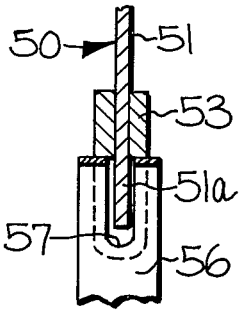
FIG. 8 is a sectional view of the releasable interconnection between the blade and spring clip and taken substantially along the line 8—8 of FIG. 5.
Figure 4:
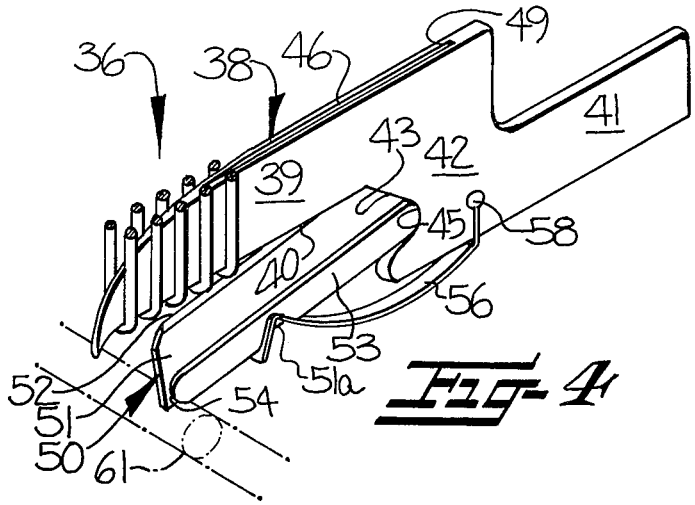
FIG. 4 is a perspective view of a loop forming and cutting apparatus embodying the present invention.

The apparatus 36 further comprises a generally flat cutting blade 50. More particularly, the cutting blade 50 includes a flat member 51 having an elongate straight cutting edge 52, and a reinforcing strip 53 mounted along the opposite edge of the flat member so as to define a shoulder 54 adjacent each end thereof. Also, the opposite edge of the blade includes a V-shaped notch (not numbered) in the strip at a medial point along its length, and as best seen in FIG. 8, the flat member 51 extends through the notch at 51. The blade 50 is operatively positioned in association with the looper 38, with the blade cutting edge 52 extending into the slot 46 and with the rearward shoulder 54 disposed in contact with the mating concave seat 45 of the looper. By this arrangement, the cutting blade 50 is adapted to pivot about the seat 45, with the cutting edge 52 and lower edge 40 of the looper forming a scissors-like bight therebetween. Also, it will be noted that the blade 50 extends forwardly beyond the forward edge 48 of the slot. Thus the intersection of the slot forward edge 48 and the lower edge 40 forms a shoulder which serves to limit the movement of the blade into the slot, and such that the bight remains open a distance sufficient to admit the yarn loops therein.

The apparatus 36 further includes means for releasably retaining the blade 50 in the above described operative position with respect to the looper, and for resiliently biasing the blade pivotally about its seat 45 and into the slot 46. This retaining and biasing means includes the notch in the lower edge of the cutting blade 50, and a spring clip 56 having one end fixed to the looper at 58 and an opposite end having a V-shaped portion which extends into the notch. Viewing FIG. 8, it will be seen that the V-shaped portion of the clip includes a slot 57 for receiving the portion **51*a* of the flat member 51 which extends through the notch, to thereby preclude relative lateral shifting. Thus the cutting blade 50 may be conveniently and easily removed from the looper by manually lowering the spring clip 56 from the notch 55**, and withdrawing the blade from the slot in the looper. A new blade may be inserted by simply reversing the above procedure.

In operation, the yarn loops are successively deposited on the looper bill 39 in the manner illustrated in FIG. 3. In this regard, it will be understood that the illustrated looper and blade is also useable in a more conventional tufting machine wherein the looper and knife assembly is moved to pick-up the loops from needles which reciprocate without lateral movement. In either case, the yarn loops are moved rearwardly along the length of the bill 39 by the movement of the fabric F, and are severed upon reaching the bight. As the cutting edge 52 of the blade 50 at the bight becomes dull, the blade will pivot downwardly against the biasing force of the spring clip 56 to bring an unused, sharp portion of the edge 52 into operation. It will also be noted that the bight formed along the lower edge 40 and cutting edge 52 substantially bisects the yarn loops. Thus the two severed yarn ends of each loop are of substantially equal length, and J-cutting is thereby effectively avoided. Also, it will be noted that the pile height remains constant as the blade becomes dull.

As a further aspect of the present invention, the machine 10 preferably includes sensing means for detecting movement of any cutting blade away from the bill beyond a predetermined limit, so that the sharpness of the cutting edge 52 of the each blade may be monitored. As illustrated, this sensing means comprises a light source 60 at one side of the machine for directing a light beam 61 along a transverse direction immediately below the row of looper and knife assemblies. A photoelectric sensor 62 is mounted on the opposite side of the machine, and is operatively connected through a suitable stop motion device 64 to the two motors M which power the tufting machine. Thus when any one of the blades 50 becomes excessively dull, it will be pivoted downwardly to break the light beam 61, which in turn causes the sensor 62 and stop motion device 64 to stop the operation of the machine. The operator may then readily locate the dull blade, and replace the same in the manner described above.

In the drawings and specification, there has been set forth a preferred embodiment of the invention, and although specific terms are employed, they are used in a generic and descriptive sense only and not for purposes of limitation.

That which is claimed is:

1. A yarn loop forming and cutting apparatus for use in a cut pile tufting machine and comprising a looper having an elongate forwardly directed bill and which defines a longitudinally extending substantially straight edge, a cutting blade having an elongate cutting edge, means for movably mounting said blade to said looper such that the cutting edge of said blade cooperates with said edge of said bill to form a forwardly facing bight therebetween, and including means for resiliently biasing said blade in a direction toward said edge of said looper bill, and means for limiting the movement of said blade toward said edge of said looper bill and such that the bight remains open a distance sufficient to admit yarn loops therein, whereby loops of yarn may be moved rearwardly along said bill and severed upon reaching the bight formed between said edge of said looper bill and said blade cutting edge.

2. The yarn loop forming and cutting apparatus as defined in claim 1 wherein said mounting means includes a slot extending transversely into said bill and communicating with said straight edge thereof, and with the rearward portion of said blade cutting edge being disposed within said slot.

3. The yarn loop forming and cutting apparatus as defined in claim 2 wherein said mounting means further comprises a pivotal interconnection between said looper and blade and which is positioned adjacent the rearward end of said slot and the rearward end of said blade.

4. The yarn loop forming and cutting apparatus as defined in claim 3 wherein said biasing means comprises a spring clip releasably mounted between said looper and blade, whereby the blade may be readily removed and replaced upon becoming dull.

5. A yarn loop forming and cutting apparatus for use in a cut pile tufting machine or the like and comprising a generally flat looper comprising a longitudinally extending bill having a longitudinally extending, straight, first edge; an oppositely extending mounting portion; and an intermediate portion having a second edge which communicates with said first edge and extends generally transversely therefrom, said second edge including an arcuately curved portion which defines a concave seat, a slot extending transversely into said bill and communicating with said first edge, and a generally flat cutting blade having an elongate straight cutting edge and a laterally extending shoulder adjacent one end thereof, said blade being operatively positioned in association with said looper with said blade cutting edge extending into said slot and with said shoulder disposed in contact with said concave seat, whereby said cutting blade is adapted to pivot about said seat, with said cutting edge and first edge forming a forwardly facing scissors-like bight therebetween, and means extending between said looper and blade for releasably retaining said blade in said operative position, and for resiliently biasing said blade pivotally about said seat and into said slot.

6. The yarn loop forming and cutting apparatus as defined in claim 5, wherein said slot terminates at a point spaced from the forward free end of said looper bill to define a corner at the juncture of said slot and first edge, and said blade has a longitudinal length sufficient to extend beyond said corner and such that the corner limits the extent to which the blade may be pivoted into said slot.

7. The yarn loop forming and cutting apparatus as defined in claim 6 wherein said seat and shoulder are respectively positioned such that said cutting edge is disposed at an angle with respect to said first edge when said blade contacts said corner.

8. The yarn loop forming and cutting apparatus as defined in claim 5 wherein said blade retaining and biasing means comprises a notch in the edge of said cutting blade opposite said cutting edge, and a spring clip having one end attached to said looper and an opposite end extending into said notch, whereby the cutting blade may be removed from said looper by manually withdrawing the spring clip from the notch and withdrawing the blade from the slot in the looper.

9. The yarn loop forming and cutting apparatus as defined in claim 8 wherein substantially the full longitudinal length of said bill and said intermediate portion are composed of a pair of flat components, which are spaced apart along a portion of their longitudinal length to define said slot, and wherein said slot extends into a portion of said intermediate portion, and the rearward end portion of said cutting blade extends into that portion of the slot in the intermediate portion of said looper.

10. In a tufting machine for forming a cut pile fabric and which includes a plurality of needles transversely aligned across the machine for carrying yarns through a backing fabric which is moved longitudinally past the needles, the combination therewith of looper means operatively associated with each of said needles for forming and cutting loops of the yarn carried through the backing fabric by the associated needle, each looper means comprising a looper having a longitudinally extending bill and which includes a longitudinally extending substantially straight edge positioned on the side of said bill opposite the needles, a cutting blade having an elongate, straight cutting edge, means for movably mounting said blade to said looper such that the cutting edge of said blade cooperates with said edge of said bill to form a forwardly facing bight therebetween, and including means for resiliently biasing said blade in a direction toward said edge of said looper bill, and means for limiting the movement of said blade toward said edge of said looper bill and such that the bight remains open a distance sufficient to admit yarn loops therein, whereby loops of yarn are moved rearwardly along said bill and severed upon reaching the bight formed between said edge of said looper bill and said blade cutting edge, and wherein the movement of the yarn loops into the bight tends to move the blade away from said edge of said looper bill and against the force of said biasing means.

11. The tufting machine as defined in claim 10 wherein said looper means are transversely aligned across the machine, and further comprising sensing means mounted on said machine and disposed adjacent the side of said looper means opposite the needles for detecting movement of said cutting blade away from said bill beyond a predetermined limit, to thereby monitor the sharpness of the cutting edge of each blade.

12. The tufting machine as defined in claim 11 wherein said sensing means comprises a light beam and a photoelectric sensor.

13. The tufting machine as defined in claim 12 further comprising means responsive to a signal from said sensing means for automatically terminating operation of the machine.

* * * * *